US010144559B2

(12) United States Patent
Pérez Guevara

(10) Patent No.: US 10,144,559 B2
(45) Date of Patent: Dec. 4, 2018

(54) CONTAINERS PREVENTING FORGERY OR ADULTERATION

(71) Applicant: José Antonio Pérez Guevara, Estado (MX)

(72) Inventor: José Antonio Pérez Guevara, Estado (MX)

( * ) Notice: Subject to any disclaimer, the term of this patent is extended or adjusted under 35 U.S.C. 154(b) by 315 days.

(21) Appl. No.: 14/912,921

(22) PCT Filed: Apr. 28, 2014

(86) PCT No.: PCT/MX2014/000065

§ 371 (c)(1),
(2) Date: Feb. 19, 2016

(87) PCT Pub. No.: WO2015/047068

PCT Pub. Date: Apr. 2, 2015

(65) Prior Publication Data

US 2016/0194120 A1 Jul. 7, 2016

(30) Foreign Application Priority Data

Sep. 24, 2013 (MX) ..... MX/u/2013/000476

(51) Int. Cl.
*B65D 85/00* (2006.01)
*B65D 49/00* (2006.01)
(Continued)

(52) U.S. Cl.
CPC ..... *B65D 49/00* (2013.01); *A45D 34/00* (2013.01); *A61J 1/14* (2013.01)

(58) Field of Classification Search
CPC ..... B65D 49/00; A45D 34/00; A61J 1/14
(Continued)

(56) References Cited

U.S. PATENT DOCUMENTS 679,415 A 7/1901 Clark
1,142,739 A 6/1915 Townsend
(Continued)

FOREIGN PATENT DOCUMENTS

WO 2005115876 A1 12/2005
WO 2014096933 A1 6/2014

*Primary Examiner* — Luan K Bui
(74) *Attorney, Agent, or Firm* — Luoh J. Wu; Continent Patent Office LLP

(57) ABSTRACT

The invention relates to the modification applied to different types of containers made from glass or other materials in order to render them unusable as original containers. The invention consists in the modification of the design, structure and production of any container, forming same in two parts connected by a tubular element surrounded by a plastic or other material which provides rigidity, but which also facilitates the disablement thereof by means of the application of a force by the consumer, facilitating the breakage thereof and preventing the subsequent use thereof as original container. In terms of the historical development of containers, this application is novel in that it can be used to eliminate the forgery of containers or bottles used in international and national perfumery, wine, pharmaceutical and other industries, providing an instrument which is more than effective in controlling forgery and adulteration in the above-mentioned markets.

9 Claims, 4 Drawing Sheets

(51) Int. Cl.
*A45D 34/00* (2006.01)
*A61J 1/14* (2006.01)

(58) Field of Classification Search
USPC ..... 206/459.1, 459.5, 807; 215/250, 253, 215/254; 222/153.05, 153.06
See application file for complete search history.

(56) References Cited

U.S. PATENT DOCUMENTS 4,420,089 A * 12/1983 Walker ..... B65D 50/066 215/216
4,630,743 A * 12/1986 Wright ..... B65D 50/046 215/216
4,640,427 A * 2/1987 Marino ..... B65D 55/06 156/272.8
4,724,972 A * 2/1988 Marcus ..... B65D 55/02 215/223
5,048,706 A * 9/1991 de Vaujany ..... B65D 51/002 215/251
5,052,574 A * 10/1991 McKinnon ..... B65D 43/0212 215/254
6,655,553 B2 * 12/2003 Staniszewski ..... B65D 47/0804 215/251
2008/0230559 A1 * 9/2008 Nardone ..... B65D 49/00 222/153.05
2012/0223103 A1 * 9/2012 Moreau ..... B05B 11/3049 222/153.06
2016/0148543 A1 * 5/2016 Spreck ..... B05D 3/12 206/459.5

* cited by examiner

CONTAINERS PREVENTING FORGERY OR ADULTERATION

INVENTION FIELD

The invention herein generally refers to a system used to disable the use of containers, especially, to a mechanism to enable the controlled breaking of containers for commercial products, by applying torsional stress from the user,

INVENTION BACKGROUND

Currently, the struggle against forgery or piracy of commercial products and, especially, products in glass bottles, or bottles made of other materials, used in the perfume, wine and pharmaceutical industry, for example, has become one of the biggest concerns for legitimate businessmen, who try to protect the integrity of their products and make sure the consumers always know they are purchasing an original and legitimate product. Thus, several safety devices have been developed to validate the original quality of the container and its content. Nevertheless, there is not a system that focuses on disabling the use of the container to prevent it from being reused.

In view of the above, it is necessary to provide a system that allows the disabling of containers for commercial products, in order to prevent them from being reused, which avoid piracy of products from industries such as the perfume, wine and pharmaceutical industry, preventing forgery of their contents and making the user feel more confident about the authenticity of the contents,

INVENTION SUMMARY

In order to solve the problems above, the invention herein is aimed at providing a system to prevent the containers from being reused.

One of the main objectives of this invention is to provide a system to disable containers that can be performed in an economic way through some modifications to the manufacturing process of such container.

Another objective of this invention is to provide a mechanism for the controlled rupture of a container by applying external strength from a user.

Another objective of this invention is to provide a system to disable containers, which can be applied to any type of container, regardless of its shape or manufacturing materials.

Another objective of the invention herein is to provide a system to disable containers which, once they have been used, can be recycled through conventional methods.

Another objective of this invention is to provide a container comprising the disabling system described in the invention herein.

The aforementioned objectives, as well as other objectives, and the advantages of the invention herein will become evident through the following detailed description thereof.

DESCRIPTION OF THE FIGURES ILLUSTRATING THE INVENTION

DETAILED DESCRIPTION OF THE INVENTION

The invention relates to the modification applied to different types of containers made from glass or other materials in order to render them unusable as original containers.

Figure 1:
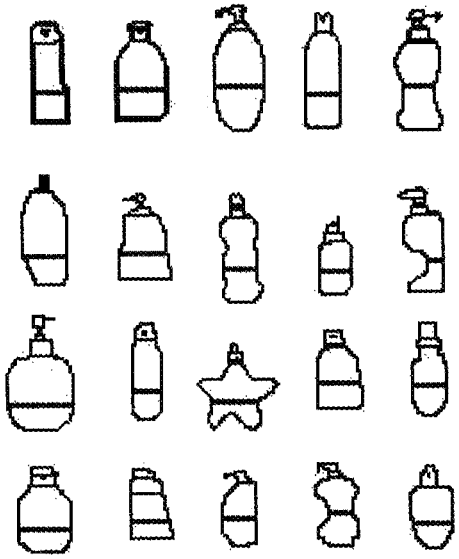
FIG. 1 is the representation of this invention's system location in various kinds and shapes of containers.
Figure 2:
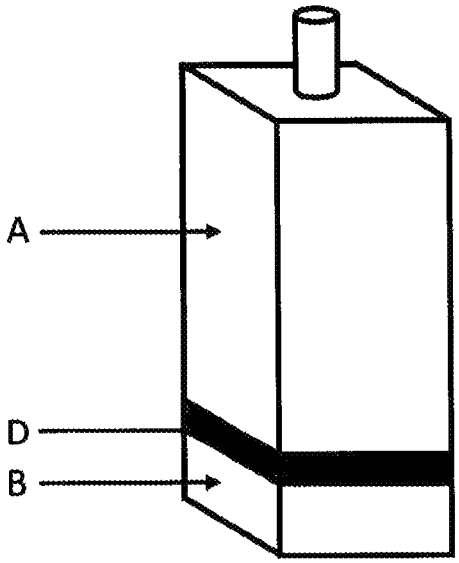
FIG. 2 is a view of a container with the system in the invention herein.
Figure 3:
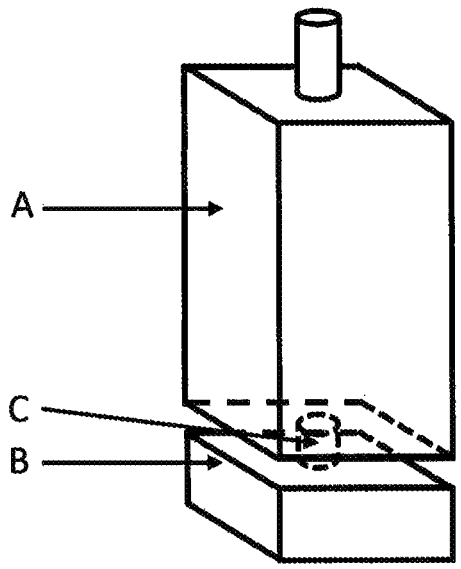
FIG. 3 is a view of the container-disabling system, showing the location of the breaking mechanism in the invention herein.
Figure 4:
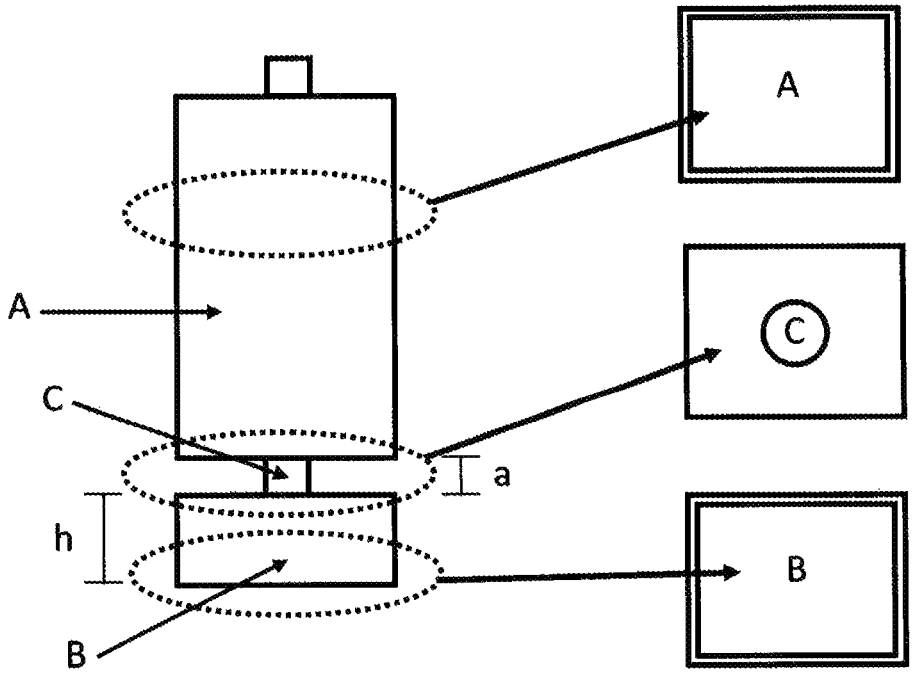
FIG. 4 is a lateral view of a container with the system in the invention herein, showing the location of each one of the elements.
Figure 5:
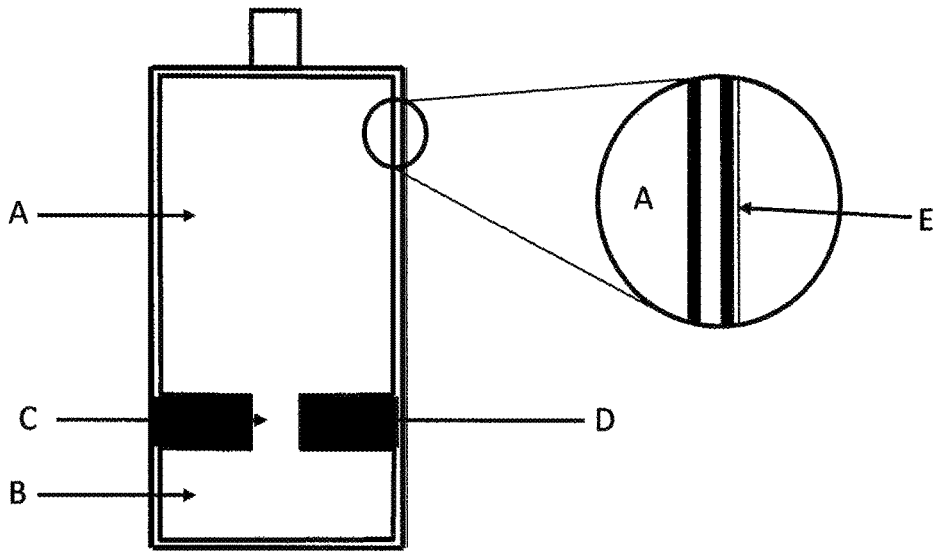
FIG. 5 shows a cut of a container with the system in the invention herein.
Figure 6:
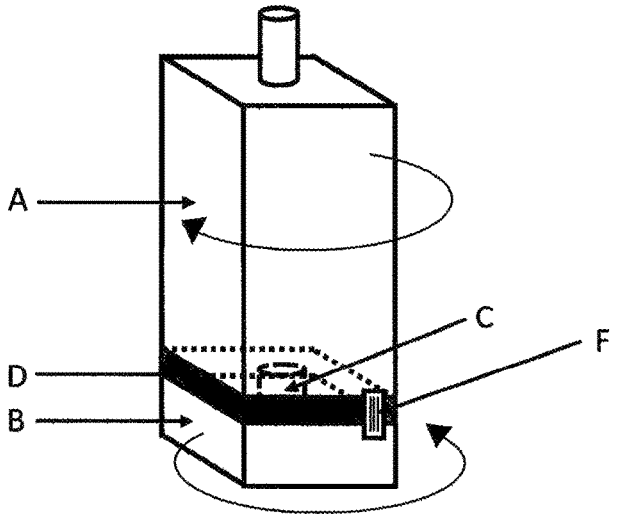
FIG. 6 shows the operation of the system when applying torsion strength.
Figure 7:
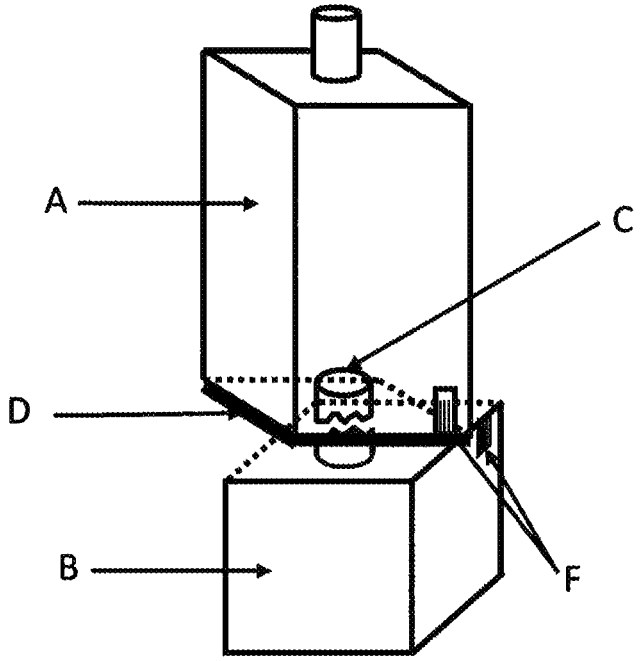
FIG. 7 shows a container after breaking the rupture mechanism in the invention herein.

As seen in FIGS. 1 to 7, the invention refers to a system comprising a breaking mechanism, which consists of a constriction in the body of a container, modifying the manufacturing or blowing molds, or any kind of mold, in such a way that a tube (c) is formed as a breaking point in the body of the container; such tube (c) can have any desired configuration (circular, semi-circular or any other) and it divides the container into two sections (A) and (B) located at the top and the bottom of the container, respectively. The height (h) of the section (B) is previously determined to generate a maximum-grip area. As seen in FIGS. (2) to (4), the tube (c) is built into sections (A) and (B), and it creates a variable height space (a) where a ring (D) is located, which is made from plastic or other appropriate material, with smooth surfaces, which makes contact with the sections (A) and (B) of the container, strengthening the tube (C) in order to mechanically support the container and allow the safe transfer and use of the container, under normal conditions. Once the ring is formed, at least one safety element (F) is placed, which can be a label, a hologram, a seal or any other kind of element (FIG. 6); joining the external surfaces of the sections (A) and (B), which is placed on the external part of the ring (D).

Once the system is formed, it can be covered by a different clear material, covering the sections (A) and (B) and the ring, and creating a continuous external surface, as seen in FIG. (5), in such a way that, when torsion strength is applied by the user between those sections (A) and (B) and breaking the tube (C) dividing sections (A) and (B) into two separate parts, these are trapped, inside the film (E), as well as the tube fragment (C), the ring (D) and at least one safety element (F), which will be broken, rendering the container unusable.

The system described above allows an external torsion strength applied by the user on sections (A) and (B) to break the tube (C) by rotating the sections (A) and (B) in opposite directions, compromising the integrity of the container's body and the safety element (F), as shown in FIGS. (6) and (7). Such rupture prevents the container from being reused as leak areas will be created, and the tube (C) material fragments are contained in the ring (D) and the film (E), preventing them from falling out.

The invention claimed is:

1. A system to disable the body of a container characterized by comprising:

a) a rupture mechanism arranged to make the container more fragile, with a constriction or tube (C) arranged to divide the container into the two sections (A) and (B), separated by a space (a), in such a way that the two sections (A) and (B) are integrally joined together by the tube (C);

b) a strengthening material arranged to create a ring (D) between the two sections (A) and (B), for restricting the movement between the two sections (A) and (B), and providing mechanical support to the container during its use and transportation and;

c) at least one safety element (F) placed between the two sections (A) and (B) and on the external surface of the ring (D), in such a way that when a user applies torsion strength between the two sections (A) and (B), the tube (C) turns into a breaking point that compromises the integrity of the tube, dividing the two sections (A) and (B) into two parts, and breaking the at least one safety element (F) thus rendering the container unusable.

2. The system according to claim 1, wherein the system further comprises a film (E) made from a clear material, for covering the two sections (A) and (B) and the ring (D) arranged between the two sections (A) and (B), to create a continuous external surface, in such a way that when the user applies torsion strength between the two sections (A) and (B), the tube (C) breaks dividing the two sections (A) and (B) into two parts which are trapped inside the film (E) along with fragments of the tube (C), the ring (D) and the at least one safety element (F) broken, rendering the container unusable.

3. The system according to claim 1, wherein the tube (c) has a circular, triangular, semi-circular shape, or any other shape required.

4. The system according to claim 1, wherein the strengthening material is a plastic material or other material that provides to the container the required mechanical support.

5. The system according to claim 1, wherein the at least one safety element is a seal, a hologram, a label, a barcode, or a numeric code.

6. The system according to claim 1, wherein the container is a container for commercial products, made from a material selected from a group consisting of glass, and other appropriate materials.

7. The system according to claim 6, wherein the container is a container for alcoholic beverages.

8. The system according to claim 6, wherein the container is a container for perfume.

9. The system according to claim 6, wherein the container is a container for pharmaceutical products.

* * * * *